US005377970A

United States Patent [19]

Kikuchi

[11] Patent Number: 5,377,970

[45] Date of Patent: Jan. 3, 1995

[54] SHEET FEEDING APPARATUS WITH REDUCED VIBRATION SEPARATOR

[75] Inventor: Yutaka Kikuchi, Kawasaki, Japan

[73] Assignee: Canon Kabushiki Kaisha, Tokyo, Japan

[21] Appl. No.: 26,091

[22] Filed: Mar. 4, 1993

Related U.S. Application Data

[63] Continuation of Ser. No. 687,033, Apr. 18, 1991, abandoned.

[30] Foreign Application Priority Data

Apr. 20, 1990 [JP] Japan ..... 2-105063

[51] Int. Cl.[6] ..... B65H 3/52

[52] U.S. Cl. ..... 271/121; 271/117; 271/124

[58] Field of Search ..... 271/4, 117, 121, 124, 271/125

[56] References Cited

U.S. PATENT DOCUMENTS

| | | | |
|---|---|---|---|
| 3,583,696 | 8/1971 | Runzi | 271/4 |
| 3,995,952 | 12/1976 | Schoppe | 271/122 X |
| 4,387,889 | 6/1983 | Koyama et al. . | |
| 4,395,036 | 7/1983 | Bergman et al. . | |
| 4,548,397 | 10/1985 | Rünzi | 271/121 |
| 4,635,922 | 1/1987 | Roetter et al. | 271/121 X |
| 5,120,042 | 6/1992 | Goto et al. | 271/117 |
| 5,120,043 | 6/1992 | Marzullo | 271/124 X |

FOREIGN PATENT DOCUMENTS

| | | | |
|---|---|---|---|
| 0279402 | 8/1988 | European Pat. Off. . | |
| 3017329 | 11/1980 | Germany . | |
| 3334522 | 3/1984 | Germany . | |
| 152736 | 9/1983 | Japan | 271/121 |
| 153737 | 9/1984 | Japan | 271/121 |
| 221023 | 10/1986 | Japan | 271/121 |
| 57445 | 3/1988 | Japan | 271/121 |
| 123731 | 5/1988 | Japan | 271/121 |
| 196432 | 8/1988 | Japan | 271/121 |
| 225043 | 9/1988 | Japan | 271/121 |
| 23129 | 1/1990 | Japan | 271/121 |

*Primary Examiner*—Robert P. Olszewski
*Assistant Examiner*—Boris Milef
*Attorney, Agent, or Firm*—Fitzpatrick, Cella, Harper & Scinto

[57] ABSTRACT

The present invention provides a sheet feeding apparatus with a sheet support for supporting sheets, a supply roller for feeding out the sheets from the sheet support, and a separator for separating the sheets fed from the supply roller one by one, the separator including a fixed frictional separating pad, a rotary member mounted for movement in contact with and in separation from the frictional separating pad, and a bias mechanism for biasing the rotary member to it urge against the frictional separating pad. The sheets fed from the supply means are separated one by one by passing the sheet through a contact area between the rotary member and the frictional separating pad.

11 Claims, 6 Drawing Sheets

SHEET FEEDING APPARATUS WITH REDUCED VIBRATION SEPARATOR

This application is a continuation, of application Ser. No. 07/687,033 filed Apr. 18, 1991, now abandoned.

BACKGROUND OF THE INVENTION

1. Field of the Invention

The present invention relates a sheet feeding apparatus for separating and feeding a sheet one by one by the cooperation of a feeding means such as rubber roller or rubber belt with a frictional separating means such as a rubber sheet embedding cork therein, which is urged against the feeding means.

2. Related Background Art

As shown in FIG. 11, a conventional sheet feeding apparatus comprises a cylindrical roller 1 rotatably supported by a body 2 and rotatingly controlled by a clutch CL and the like. An uppermost sheet P of a sheet stack contained in a sheet cassette 3 is urged against the roller 1 by means of a bias spring 5 via an imtermediate plate 4 of the cassette. Further, a rubber sheet 6 made of rubber material with cork embedded therein is pressed against the roller 1 at a downstream side of a contact area between the roller 1 and the sheet stack with respect to a sheet feeding direction. The rubber sheet 6 is fixed to a guide plate 7 which is rotatably supported by a shaft *7a* extending perpendicular to the sheet feeding direction. The guide 7 is biased toward the roller 1 by means of a spring 8 so that the rubber sheet 6 is pressed against the roller 1 with a predetermined pressure. As sheets pass through a contact area between the rubber sheet 6 and the roller 1, the sheet P is separated one by one and is fed out.

However, in the above-mentioned conventional sheet feeding apparatus, as the sheet P is being fed pinched by the roller 1 with the rubber sheet 6 acting as the frictional separating means, fine vibration is created due to the sliding friction between the sheet P and the rubber sheet 6, which is transmitted to the rubber sheet 6 and the guide plate 7 supporting it, thus generating noise. The noise varies with the kind of sheets such as an OHP sheet, and, since such noise becomes the continuous discordant noise during the feeding of the sheet, in the conventional sheet feeding apparatus, such noise was minimized by increasing the weight of a supporting member for the guide plate 7, i.e., the separating means, or by providing a weight for preventing the vibration, or by reducing the coefficient of friction of the surface of the separating means. However, since the frictional separating means is urged against the roller 1 by the elastic means such as the spring 8 and the like, it was very difficult to suppress the vibration.

Further, when the sheet is fed to a next feeding means (for example, registering rollers) 9 in the frictional separating portion, since, in the separating portion, the sheet P is pinched between the rubber sheet 6 of the frictional separating means and the roller 1 which is now freely rotated due to an OFF condition of the clutch CL, the sheet P continues to slidingly contact with the rubber sheet 6 until a trailing end of the sheet leaves the rubber sheet. In addition, the rubber sheet 6 is so arranged that it can follow the movement of the sheet P by smoothly rocking or pivoting during the feeding of the sheet P. Thus, the fine vibration created by the sliding friction between the rubber sheet 6 and the sheet P is transmitted to the whole structure including the guide plate 7, thus creating significant noise.

Now, the generation of the fine vibration will be fully described.

When the sheet P is drawn between the rubber sheet 6 having high coefficient of friction and the freely-rotated roller 1, the sheet first remains stationary due to the static friction until a force applied to the sheet reaches a predetermined value. When the force exceeds the predetermined value, the sheet P starts to move. As the sheet P moves, the dynamic friction is gradually increased to decrease the speed of the sheet P, and, ultimately to stop the sheet again. When the sheet is stopped, since the static friction acts on the sheet P, the latter remains stationary until the force reaches the predetermined value. In this way, the movement and stop of the sheet P are repeated alternately (this is called as "stickslip"). These repeated movements are amplified by the pivotable guide plate 7 to create the great vibration in the sheet feeding direction, thus generating the noise.

SUMMARY OF THE INVENTION

An object of the present invention is to provide a sheet feeding apparatus which can eliminate the above-mentioned conventional drawbacks and prevent the generation of noise during the separation of a sheet.

In order to achieve the above object, the present invention provides a sheet feeding apparatus comprising a sheet support for supporting sheets, a supply means for feeding out the sheets from the sheet support, and a separation means for separating the sheets fed from the sheet support one by one, the separation means including a fixed frictional separating means, a rotary member mounted for movement in contact with and in separation from the frictional separating means, and a bias means for biasing the rotary member to it urge against the frictional separating means. The sheets fed from the sheet support are separated one by one by passing the sheet through a contact area between the rotary member and the frictional separating means.

In this way, by fixing the frictional separating means and by shifting a feeding means while urging it against the frictional separating means, the sheets can be separated one by one. Since the frictional separating means is fixed, it is possible to suppress the amplification of the vibration of the frictional separating means, thus preventing the generation of the noise during the feeding of the sheet.

Incidentally, since the rotary member is driven by the movement of the sheet, the vibration generated in the frictional separating means is blocked by the rotary member not to be amplified at the rotary member, thus eliminating the noise.

DETAILED DESCRIPTION OF THE PREFERRED EMBODIMENTS

Figure 1:
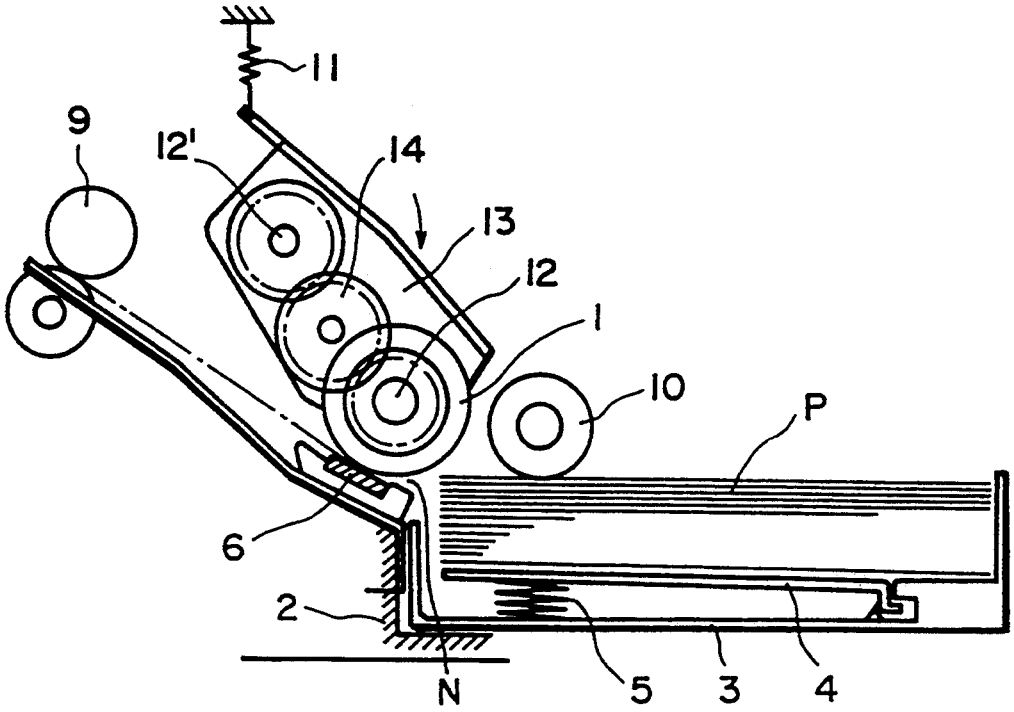
FIG. 1 is a schematic elevational sectional view of a sheet feeding apparatus according to a first embodiment of the present invention.

The present invention will now be explained in connection with embodiments thereof with reference to the accompanying drawings.

First of all, a first embodiment of the present invention will be described referring to FIGS. 1 and 2. An uppermost sheet of a sheet stack P contained in a cassette 3 is urged against a supply roller (supply means) 10 by a spring 5 via an intermediate plate 4 of the cassette. A frictional separating means 6 made of urethane rubber and the like is disposed at a downstream side of the supply roller with respect to a sheet feeding direction, and is fixed to a body 2. A roller (feeding means) 1 is rotatably supported on an arm 13 which is pivotally mounted on a drive shaft 12 and biased by a spring (pressure generating means) 11 so that the roller 1 is pressed against the frictional separating means with a predetermined pressure.

In the illustrated embodiment, the weight of the roller 1 itself also acts on the frictional separating means 6. Incidentally, the roller 1 may be urged against the frictional separating means only by the weight of the roller 1 itself. In this case, the roller 1 itself constitutes the pressure generating means. A driving force from the drive shaft 12' is transmitted to the roller 1 through a gear train 14. A clutch (not shown) is disposed in a transmission path to the drive shaft 12' from a driving power source so that transmission of the driving force from the driving power source to the roller 1 can be selectively turned ON or OFF.

When the supply roller 10 is rotated, the sheets P on the intermediated plate 4 are fed to be directed to a nip (contact area) N between the frictional separating means 6 and the roller 1 in a separating portion, where the sheet P contacting the roller 1 is further fed, but the sheet P contacting the frictional separating means 6 is braked there, whereby only one sheet can be fed out. In this case, when several sheets P enter the nip N at a time, the nip N is opened by the fact that the roller 1 is pivoted or slid. Further, when the sheet P is fed by a next feeding means (for example, registering rollers 9) in the separating portion to be drawn from the nip N in the separating portion, the roller 1 can be smoothly pivoted to follow the movement of the sheet P, thus preventing the double feed of the sheets.

Figure 3:
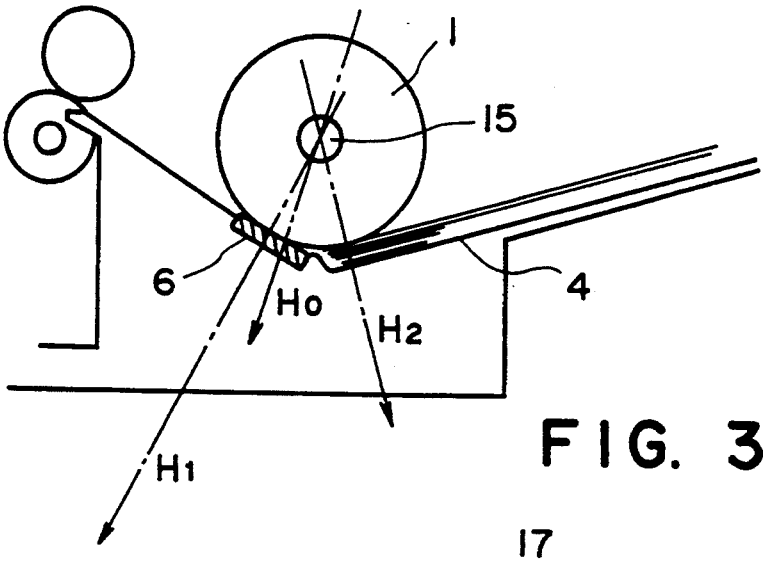
FIG. 3 is a schematic sectional view of a sheet feeding apparatus according to a second embodiment of the present invention.
Figure 4:
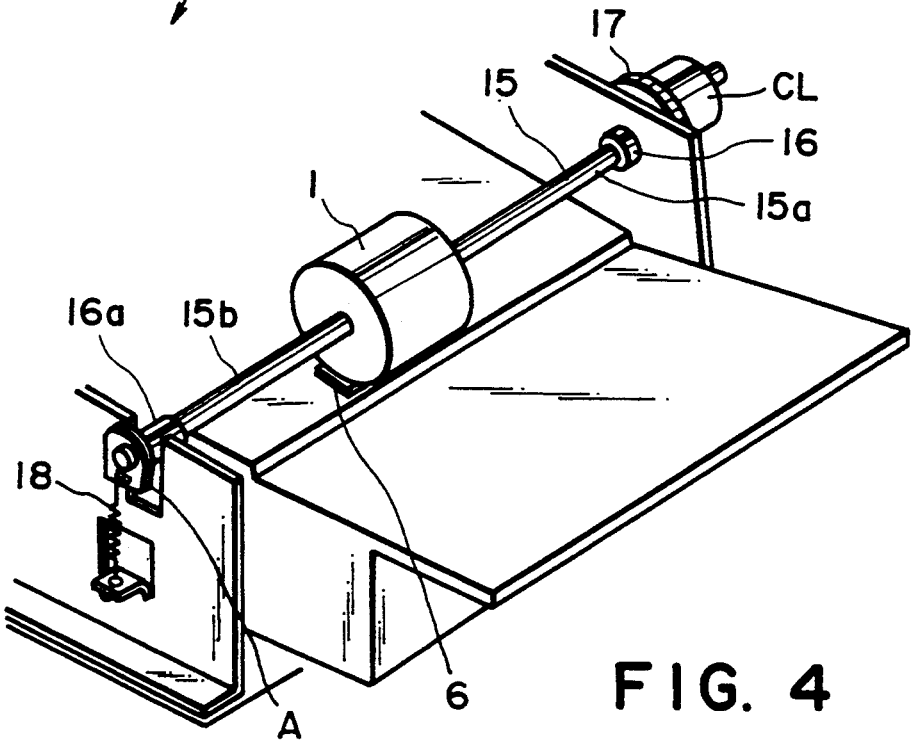
FIG. 4 is a perspective view of the sheet feeding apparatus of FIG. 3.
Figure 5:
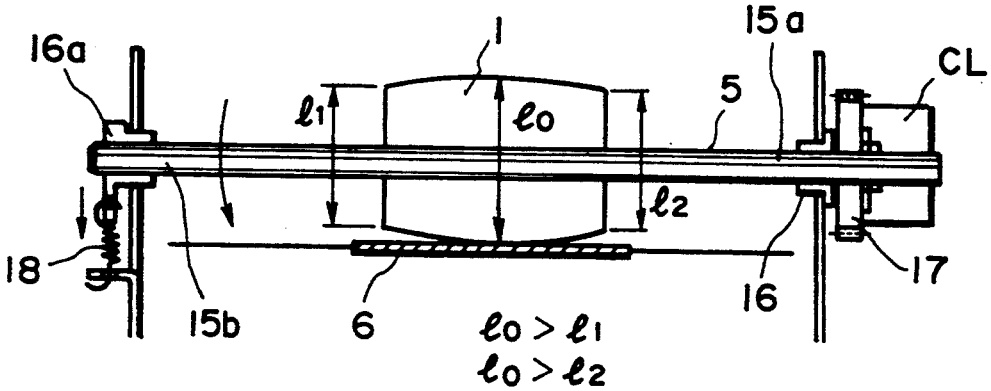
FIG. 5 is a longitudinal sectional view of a roller of the sheet feeding apparatus of FIG. 3.

Next, a second embodiment of the present invention will be explained with reference to FIGS. 3 to 5. In this embodiment, the same elements as those of the first embodiment are designated by the reference numerals and the explanation thereof will be omitted.

In this second embodiment, the supply roller 10 in the first embodiment is omitted, and the roller 1 acts as both the supply means and the feeding means. The roller 1 is fixed to a drive shaft 15 which is rotatably supported at its one end 15*a* by the body via a bearing 16. This end 15*a* is provided with a clutch CL and a clutch gear 17 which receives a driving force from a motor (not shown) via a gear train. The clutch CL can be turned ON or OFF under the control of an electric signal from a controller (not shown) to control the rotation of the roller 1. The other end 15*b* of the drive shaft 15 is supported by a bearing 16*a* which is slidably received in a slide recess A formed in the body and which is biased by a compression spring (pressure generating means) 18 to bias the drive shaft 15 of the roller 1 so that the roller 1 is urged against the frictional separating means 6 made of the urethane rubber sheet. The biasing direction $H_0$ is situated between a direction $H_1$ perpendicular to the frictional separating means 6 and a direction $H_2$ perpendicular to the sheet stack P on the intermediate plate 4, so that the roller 1 can afford the pressure to both the frictional separating means and the sheet stack.

Further, in this second embodiment, while the compression spring 18 was associated with only one end 15*b* of the drive shaft, such compression springs may be provided to cooperate with both ends 15*a*, 15*b* of the drive shaft. However, as shown, it is effective that such spring is arranged on only one end (other than the driving side) of the drive shaft and the other end (driving side) is fixed, since the pressure loss in the driving force transmission and the unstability due to the backlash in the gear train of the transmission can be prevented. Further, as shown in FIG. 5, by adopting a crown configuration of the roller 1, the contact area between the roller 1 and the frictional separating means 6 can be stabilized without eccentric contact therebetween.

Figure 6:
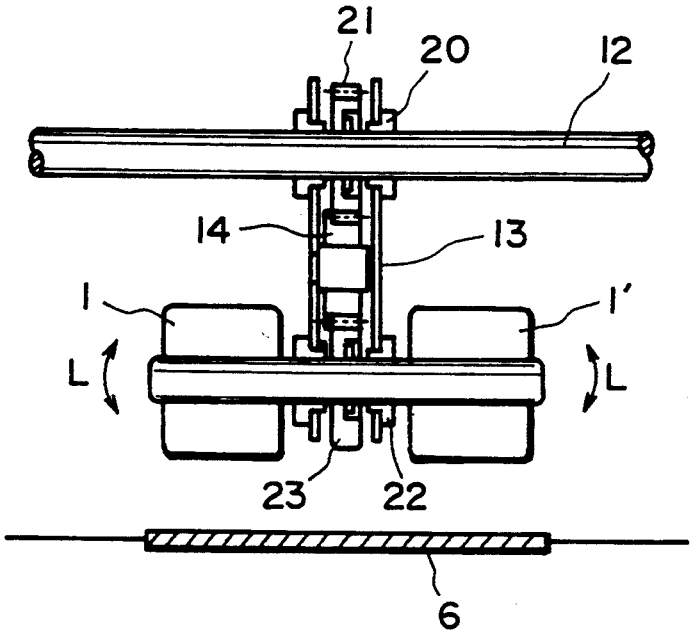
FIG. 6 is a schematic sectional plan view of a sheet feeding apparatus according to a third embodiment of the present invention.
Figure 7:
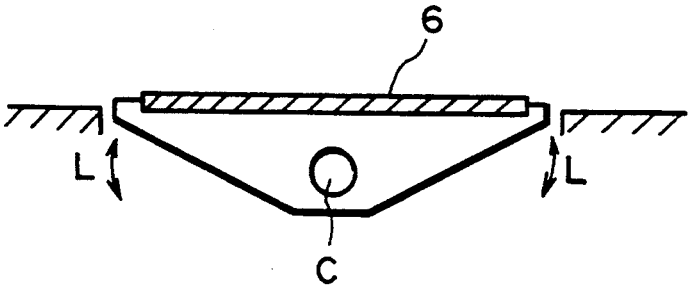
FIG. 7 is a sectional view of a part of the sheet feeding apparatus of FIG. 6.

FIG. 6 shows a third embodiment of the present invention. More particularly, in this embodiment, in order to urge the roller 1 acting as only the feeding means as in the case of the first embodiment or both the supply means and the feeding means as in the case of the second embodiment against the frictional separating means 6, as shown in FIG. 6, the transmission of the pressure and the driving force to the roller 1 is effected at the center of the roller so that the more stable separating ability can be obtained.

Also in this embodiment, the same elements as those in the previous embodiments are designated by the same reference numerals and the explanation thereof will be omitted. The drive shaft 12 has a clutch (not shown) for controlling ON/OFF of the transmission of the driving force, and an arm 13 is pivotally mounted on the center of the shaft 12 via a bearing 20. An idler gear 14 is rotatably mounted on the arm 13, which gear can transmit the driving force from a drive gear 21 fixed to the shaft 12 to the roller 1. A shaft 12' is rotatably supported by the arm 13 via a bearing 22 and is rotatingly driven by a gear 23. A pair of rollers 1, 1' are fixedly mounted on the shaft 12' on both ends thereof. The frictional separating means 6 made of urethane rubber and the like is disposed in confronting relation to the paired rollers 1 and 1'.

In this case, as shown in FIG. 6, the paired rollers 1, 1' can be rocked in directions shown by the arrows L with respect to the frictional separating means 6 which is completely fixed. In this way, the pressure contact between the frictional separating means 6 and the paired rollers 1, 1' can be stabilized. Further, as shown in FIG.

7, the frictional separating means 6 may be pivotally supported by a shaft C extending parallel to the sheet feeding direction so that it can be rocked in the direction L perpendicular to the sheet feeding direction. It this case, the frictional separating portion is constituted by the frictional separating means 6 and the roller 1 urged against the frictional separating means by its own weight or by a spring, which also provides the stable separating ability to reduce the trouble in the feeding of the sheet, such as the skew-feed of the sheet.

Incidentally, since the vibration generated in the frictional separating means 6 is directed toward the sheet feeding direction, even if the frictional separating means is rocked in the direction perpendicular to the sheet feeding direction, the vibration is not amplified.

Figure 2:
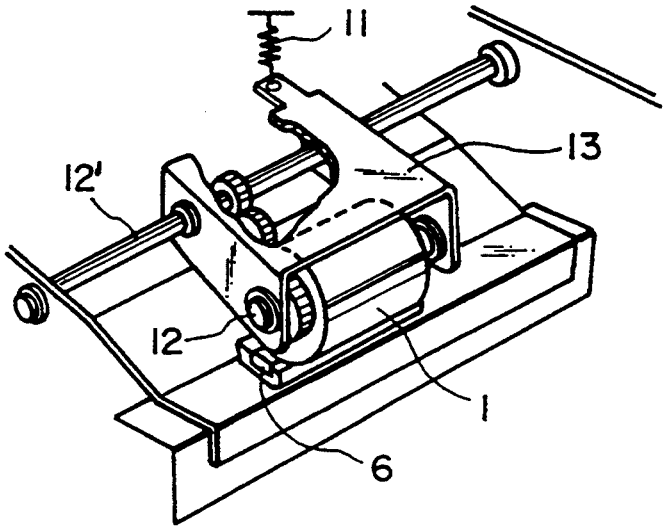
FIG. 2 is a perspective view of the sheet feeding apparatus of FIG. 1.
Figure 8:
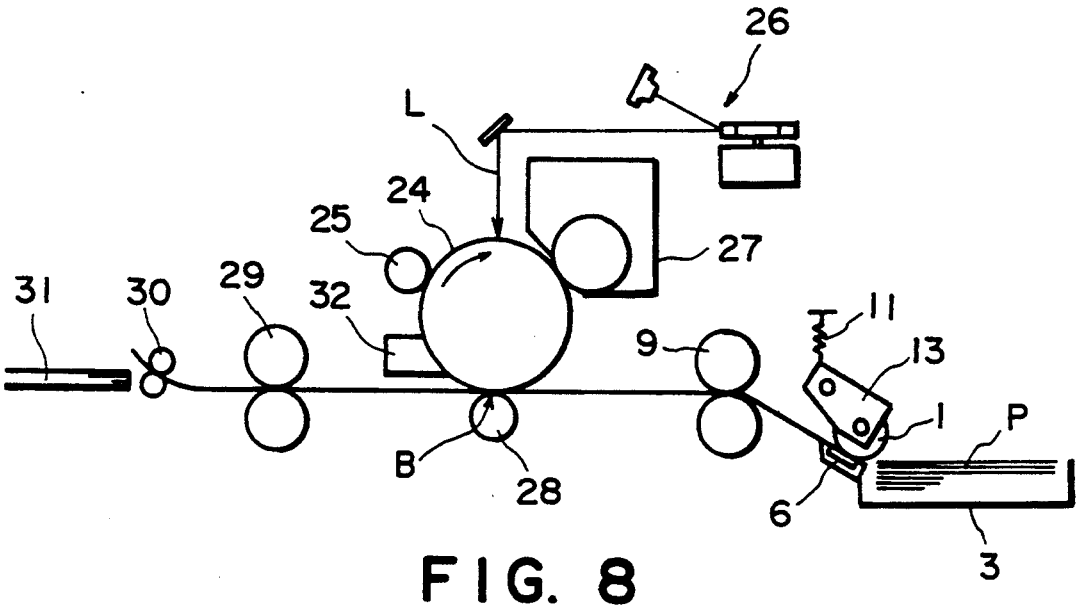
FIG. 8 is a schematic elevational sectional view of an image forming system incorporating the sheet feeding apparatus of FIG. 1.

FIG. 8 shows an image forming system incorporating the sheet feeding apparatus of FIG. 1. In this system, a latent image is formed on a surface of a photosensitive drum 24 by image information emitted from an laser beam system 26 and sent to the drum along an optical path L. The latent image on the drum 24 is visualized by a developing device 27 to form a toner image. When the toner image is brought into a transfer portion B where a transfer roller 28 is contacted with the drum 24 as the drum is rotated, the toner image on the drum 24 is transferred onto the sheet fed from the sheet feeding apparatus as mentioned above to the transfer portion B at a predetermined timing controlled by the registering rollers 9.

The sheet on which the toner image was transferred is separated from the photosensitive drum 24 and is then sent to a fixing device 29, where the image is permanently fixed to the sheet. Thereafter, the sheet is ejected onto an ejector tray 31 through ejector rollers 30 as a printed matter.

After passing through the transfer portion B, the surface of the drum 24 is cleaned by a cleaner 32 to remove the residual toner from the drum. The reference numeral 25 denotes a charger for applying the charge to the drum 24 again. In this way, the photosensitive drum can be used again to form a new image.

Incidentally, the image forming system is not limited to one utilizing the above-mentioned laser beam system, but other recording systems may be used.

Next, an ink jet recording system suitably used in combination with the sheet feeding apparatus according to the present invention will be explained.

The ink jet recording system includes liquid discharge openings for discharging recording ink liquid as flying droplets, liquid passages communicated with the discharge openings, and discharge energy generating means associated with the liquid passages for applying the discharge energy to fly the liquid in the liquid passages. By energizing the discharge energy generating means in response to an image signal, the ink droplets are discharged to form an image.

The discharge energy generating means may be, for example, a pressure energy generating means using electrical/mechanical converters such as piezoelectric elements, an electro-magnetic energy generating means for discharging ink by heating the ink by the electromagnetic wave such as laser, or a thermal energy genertaing means for discharging ink by heating the ink by means of electrical/thermal converters. Among them, the thermal energy generating means for discharging ink by heating the ink by means of electrical/thermal converters is preferable, since the discharge openings can be arranged with high density, the image can be formed with high resolving power, and the recording head can be small-sized.

In the illustrated embodiment, a bubble jet recording means of serial-type which is one kind of the ink jet recording means are used as the image recording means.

Figure 9:
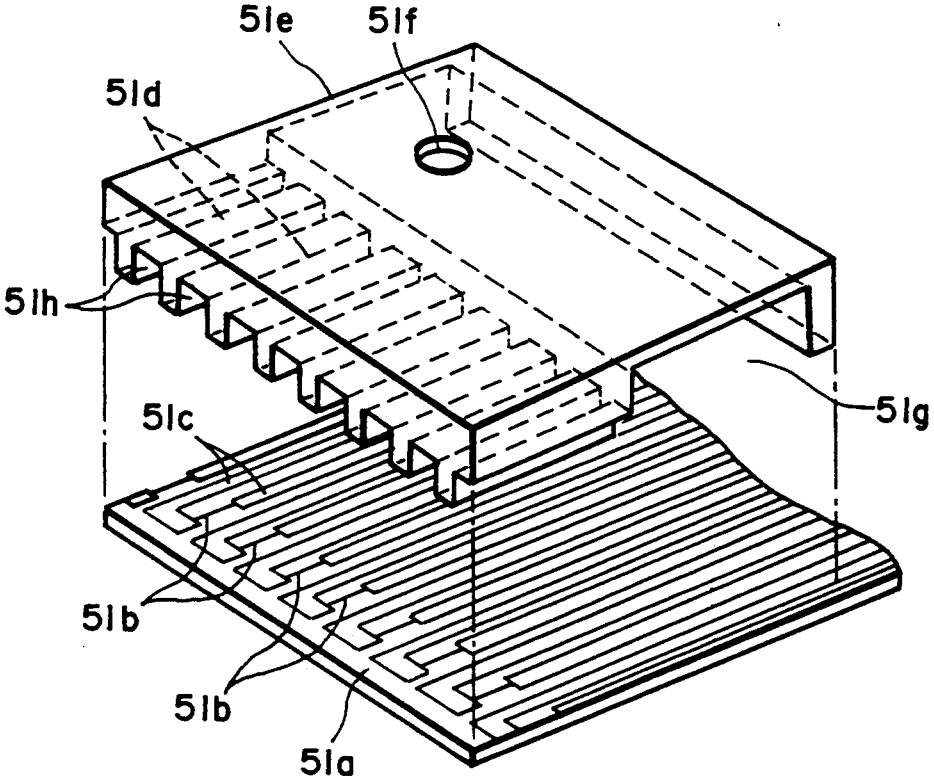
FIG. 9 is an exploded perspective view of a recording head used in an ink jet recording process, showing another example of an image forming means.
Figure 10A:
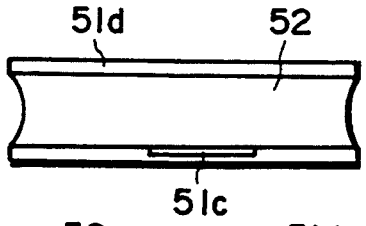
FIGS. 10A to 10G are explanatory views for explaining an ink jet recording principle.
Figure 10B:
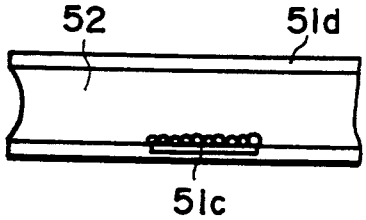
Figure 10C:
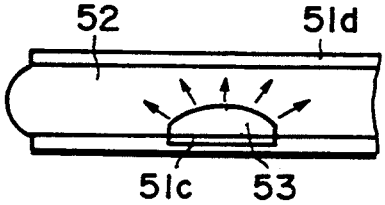
Figure 10D:
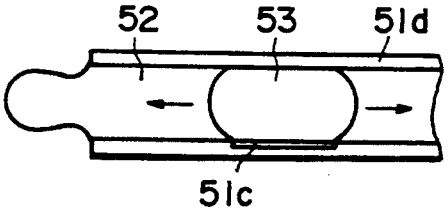
Figure 10E:
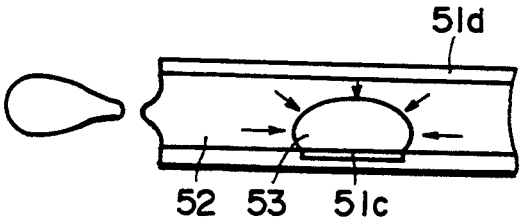
Figure 10F:
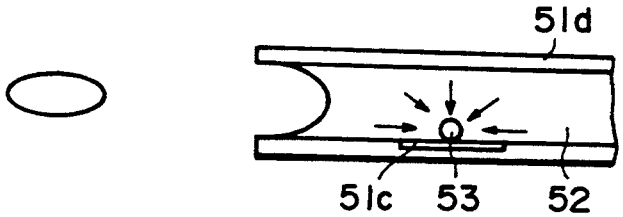
Figure 10G:
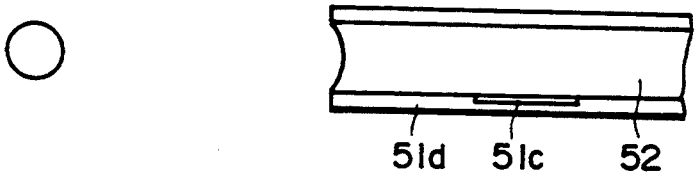
Figure 11:
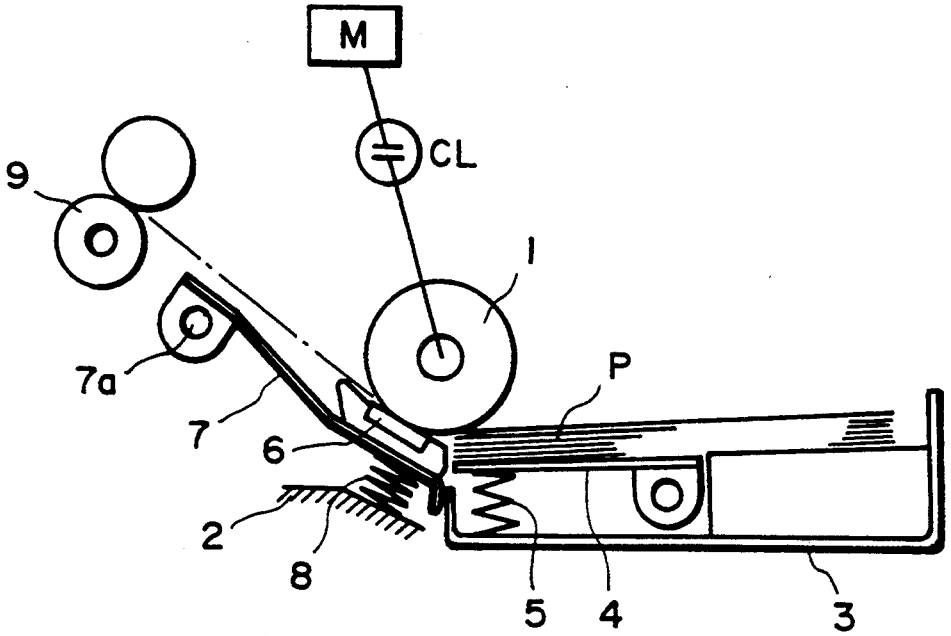
FIG. 11 PRIOR ART
FIG. 11 is an elevational sectional view of a conventional sheet feeding apparatus.

FIG. 9 shows an exploded perspective view of the recording head H constituting the recording means, and FIGS. 10A and 10G show a principle of the bubble jet recording process.

In FIG. 9, the reference numeral 51*a* denotes a heater board wherein electrical/thermal converters (discharge heaters) 51*b* and electrodes 51*c* made of aluminium which supply electric powers to the electrical/thermal converters are formed on a silicon substrate by a film forming process. A top plate 51*e* having partition walls for defining recording liquid passage (nozzles) 51*d* is adhered to the heater board 51*a*. Further, an ink cartridge (not shown) for supplying the ink to the recording head 51 is removably mounted on the head in place.

The ink supplied from the ink cartridge to the recording head via a liquid supply tube is directed to a common liquid chamber 51*g* in the head 51 through a supply opening 51*f* formed on the top plate 51*e* and then is sent to the nozzles 51*d* from the common liquid chamber 51*g*. The nozzle 51*d* have ink discharge openings 51*h*, respectively, which are disposed at a predetermined pitch along a sheet feeding direction in confronting relation to the sheet.

In the illustrated embodiment, the recording head 51 is mounted on a reciprocable carriage and the recording is performed by discharging the ink from the recording head 51 in synchronous with the shifting movement of the carriage.

Now, a principle for forming the flying droplet in the jet recording process will be explained with reference to FIGS. 10A to 10G.

In the steady-state, as shown in FIG. 10A, a tension force of the ink 52 filled in the nozzle 51*d* is equilibrated with the external force at an discharge opening surface. In this condition, when it is desirable to jet the ink, the electrical/thermal converter 51*d* disposed in the nozzle 51*d* is energized to abruptly increase the temperature of the ink in the nozzle 51*d* exceeding the nucleate boiling. Consequently, as shown in FIG. 10B, the ink portion adjacent to the electrical/thermal converter 51*d* is heated to create a fine bubble, and then the heated ink portion is vaporized to generate the film boiling, thus growing the bubble 53 quickly, as shown in FIG. 10C.

When the bubble 53 is grown at the maximum extent as shown in FIG. 10D, the ink droplet is pushed out of the discharge opening of the nozzle 51*d*. When the electrical/thermal converter 51*d* is disenergized, as shown in FIG. 10E, the grown bubble 53 is cooled by the ink 52 in the nozzle 51*d* to contract. Thus, the growth and contraction of the bubble, the ink droplet is flying from the discharge opening. Further, as shown in FIG. 10F, the ink contacted with the surface of the electrical/thermal converter 51*d* is quickly cooled, thus diminishing the bubble 53 or reduce the volume of the bubble to the negligible extent. When the bubble 53 is diminished, as shown in FIG. 10G, the ink is replenished in the nozzle 51*d* from the common liquid chamber 51*g* by a capillary phenomenon, thus preparing the next formation of the ink droplet.

Accordingly, by reciprocally shifting the carriage and by selectively energizing the electrical/thermal converters 51*b* in response to the image signal, the ink image can be recorded on the sheet.

What is claimed is:

1. A sheet feeding apparatus, comprising:

sheet stack means for stacking sheets thereon;

feeding means for feeding out the sheets from said sheet stack means;

separation means for separating the sheets fed out by said feeding means one by one, said separation means comprising a stationary frictional separating means, a rotary roller mounted on support means provided rotatably around a pivot axis provided downstream of said frictional separating means with respect to a sheet feeding direction for movement in contact with and in separation from said frictional separating means, and bias means for urging said rotary roller against said frictional separating means; and drive transmitting means for transmitting a rotation to said rotary roller, said drive transmitting means including a driven shaft disposed on said pivot axis, and at least one transmitting member for transmitting the rotation from said driven shaft to said rotary roller, wherein a first moment of said support means which acts in a direction that tends to separate said rotary roller from said frictional separating means is applied by friction between said rotary roller and said frictional separating means, and a second moment of said support means which draws said rotary roller to said frictional separating means is applied by rotation transmitted by said at least one transmitting member.

2. A sheet feeding apparatus according to claim 1, wherein said support means comprises a pivotable arm supporting at its one end said rotary roller, wherein said rotary roller is shifted in contact with and in separation from said frictional separating means by pivoting of said arm.

3. A sheet feeding apparatus according to claim 2, wherein said bias means is made of an elastic member.

4. A sheet feeding apparatus according to claim 2, wherein said bias means is constituted by weights of said rotary roller and of said pivotable arm.

5. A sheet feeding apparatus according to claim 1, wherein said feeding means also acts as said rotary rolls, whereby the sheets fed by said feeding means are separated one by one at a contact area between said feeding means and said frictional separating means.

6. An image forming apparatus, comprising:

sheet stack means for stacking sheets thereon;

feeding means for feeding out the sheets from said sheet stack means;

separation means for separating the sheets fed out by said feeding means one by one, wherein said separation means comprises a stationary frictional separating means, a rotary roller mounted on support means provided rotatably around a pivot axis provided downstream of said frictional separating means with respect to a sheet feeding direction for movement in contact with and in separation from said frictional separating means, and bias means for urging said rotary roller against said frictional separating means;

drive transmitting means for transmitting a rotation to said rotary roller, said drive transmitting means including a driven shaft disposed on said pivot axis, and at least one transmitting member for transmitting the rotation from said driven shaft to said rotary roller, wherein a first moment of said support means which acts in a direction that tends to separate said rotary roller from said frictional separating means is applied by friction between said rotary roller and said frictional separating means, and a second moment of said support means which draws said rotary roller to said frictional separating means is applied by rotation transmitted by said at least one transmitting member; and image formation means for forming an image on the separated sheet.

7. An image forming apparatus according to claim 6, wherein said feeding means is also used as said rotary roller, the sheets fed out from said feeding means being separated one by one at the nip portion between said feeding means and frictional separating means.

8. An image forming apparatus according to claim 6, wherein said image formation means forms images by a recording process wherein a latent image is firstly formed on a photosensitive drum by a laser beam and then a toner image is formed and thereafter the toner image is transferred onto the sheet.

9. An image forming apparatus according to claim 6, wherein the image formation means forms imaqes by discharging ink by an ink jet recording process.

10. An image forming apparatus according to claim 6, wherein the image formation means includes an ink jet recording process that forms an image by energizing electrical/thermal converters in response to a signal to discharge ink by the use of thermal energy generated by said electrical/thermal converters.

11. An image forming apparatus according to claim 6, wherein the image formation means includes an ink jet recording process that forms an image by energizing an electrical/thermal converter in response to a signal to discharge ink by the growth of bubble created by heating ink more than a film boiling point by said electrical/thermal converter.

* * * * *

UNITED STATES PATENT AND TRADEMARK OFFICE

CERTIFICATE OF CORRECTION

PATENT NO. : 5,377,970

DATED : January 3, 1995

INVENTOR(S) : YUTAKA KIKUCHI

It is certified that error appears in the above-indentified patent and that said Letters Patent is hereby corrected as shown below:

COLUMN 1

Line 10, "relates" should read --relates to--.
Line 11, "a sheet" should read --sheets--.
Line 12, "rubber" should read --a rubber--.

COLUMN 2

Line 37, "it urge" should read --urge it--.

COLUMN 5

Line 4, "It" should read --In--.
Line 19, "an" should read --a--.
Line 63, "taing" should read --ting--.

COLUMN 6

Line 39, "an" should read --a--.

COLUMN 7

Line 45, "rolls," should read --roller,--.

UNITED STATES PATENT AND TRADEMARK OFFICE

CERTIFICATE OF CORRECTION

PATENT NO. : 5,377,970 Page 2 of 2

DATED : January 3, 1995

INVENTOR(S) : YUTAKA KIKUCHI

It is certified that error appears in the above-indentified patent and that said Letters Patent is hereby corrected as shown below:

COLUMN 8

Line 39, "imaqes" should read --images--.
Line 51, "bubble" should read --a bubble--.
Line 52, "more" should read --to more--.

Signed and Sealed this

Twenty-third Day of May, 1995

*Attest:*

*Attesting Officer*

BRUCE LEHMAN

*Commissioner of Patents and Trademarks*